US008235379B2

(12) United States Patent
Lee

(10) Patent No.: US 8,235,379 B2
(45) Date of Patent: Aug. 7, 2012

(54) MEDIA SEPARATING APPARATUS OF AUTOMATIC MEDIA DISPENSER

(75) Inventor: Su-Min Lee, Seongnam-si (KR)

(73) Assignee: LG N-Sys Inc., Seoul (KR)

( * ) Notice: Subject to any disclaimer, the term of this patent is extended or adjusted under 35 U.S.C. 154(b) by 133 days.

(21) Appl. No.: 12/812,887

(22) PCT Filed: Jan. 19, 2009

(86) PCT No.: PCT/KR2009/000276

§ 371 (c)(1),
(2), (4) Date: Jul. 14, 2010

(87) PCT Pub. No.: WO2009/093830

PCT Pub. Date: Jul. 30, 2009

(65) Prior Publication Data

US 2011/0049786 A1 Mar. 3, 2011

(30) Foreign Application Priority Data

Jan. 21, 2008 (KR) ..... 10-2008-0006286

(51) Int. Cl.
*B65H 3/06* (2006.01)

(52) U.S. Cl. ..... 271/117; 271/121; 271/227

(58) Field of Classification Search ..... 271/117, 271/121, 122, 227

See application file for complete search history.

(56) References Cited

U.S. PATENT DOCUMENTS

| | | | | |
|---|---|---|---|---|
| 6,139,010 | A | 10/2000 | Yokoi | |
| 2004/0188918 | A1 * | 9/2004 | Morimoto et al. | 271/121 |
| 2004/0188919 | A1 * | 9/2004 | Sakamaki et al. | 271/122 |
| 2004/0207145 | A1 * | 10/2004 | Chang | 271/117 |
| 2008/0179817 | A1 * | 7/2008 | Schalk et al. | 271/121 |

FOREIGN PATENT DOCUMENTS

| | | |
|---|---|---|
| EP | 0045364 | 2/1982 |
| JP | 2002-160842 | 6/2002 |
| JP | 3802514 | 5/2006 |
| KR | 1998-035412 | 9/1998 |
| KR | 1020030022634 | 3/2003 |
| KR | 10-0419225 | 2/2004 |
| KR | 1020070029907 | 3/2007 |
| WO | 87/02018 | 4/1987 |

OTHER PUBLICATIONS

Korean Notice of Allowance for 10-2008-0006286 dated Jul. 22, 2011.

International Search Report mailed Aug. 31, 2009 for PCT/KR2009/000276.

Supplementary European Search Report for EP09703327 dated Jan. 30, 2012.

* cited by examiner

*Primary Examiner* — David H Bollinger

(74) *Attorney, Agent, or Firm* — Lowe Hauptman Ham & Berner, LLP

(57) ABSTRACT

The present invention relates to a media separating device of an automatic media dispenser. According to the present invention, when a skew of a medium is detected when the medium is separated and conveyed, a pick-up bracket mounted with a pick-up roller is rotated in a direction away from the push plate, so that the pick-up bracket is separated from the medium which is ready to be received in the media box.

16 Claims, 6 Drawing Sheets

【FIG.1】
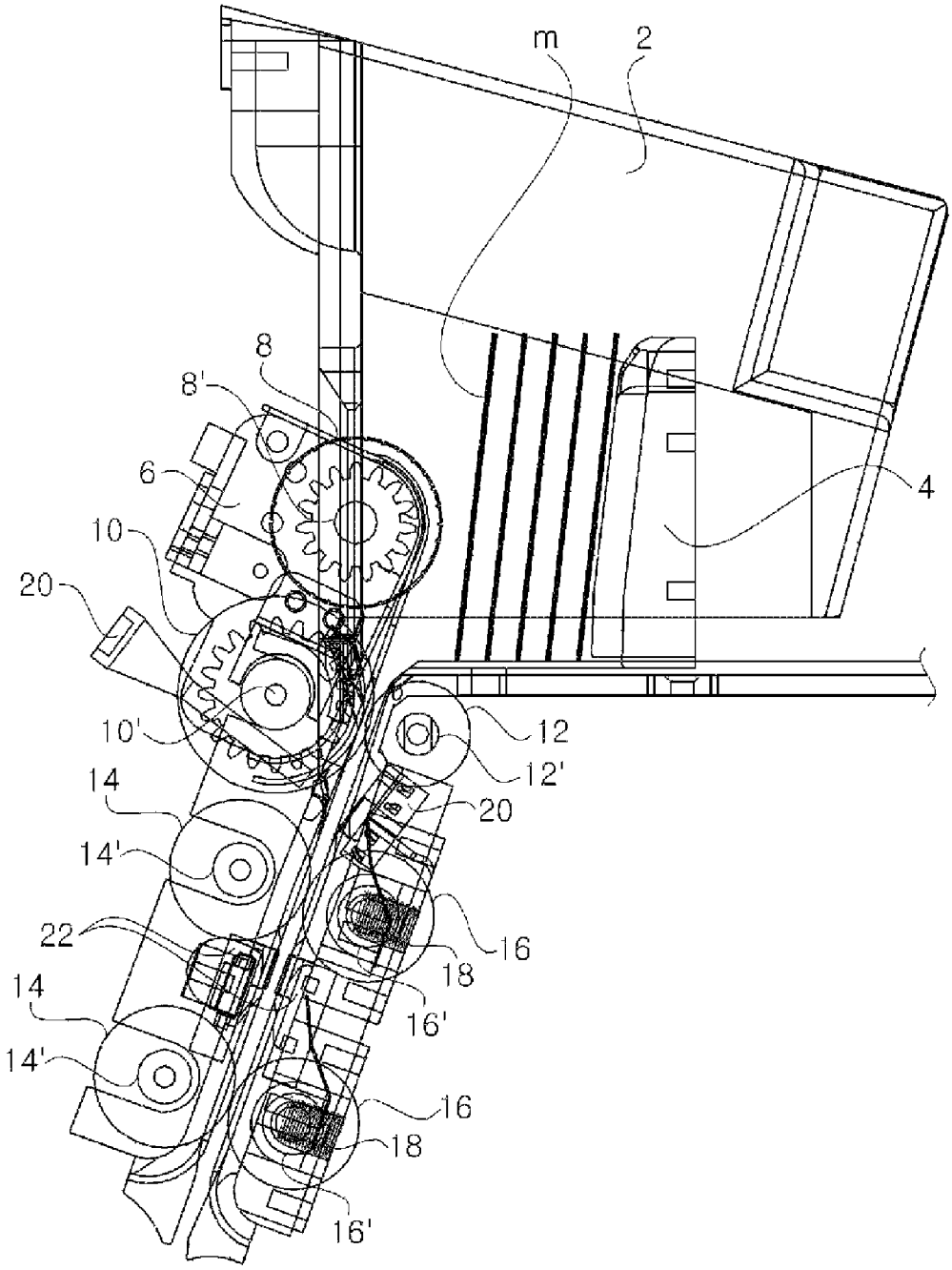

【FIG.2】
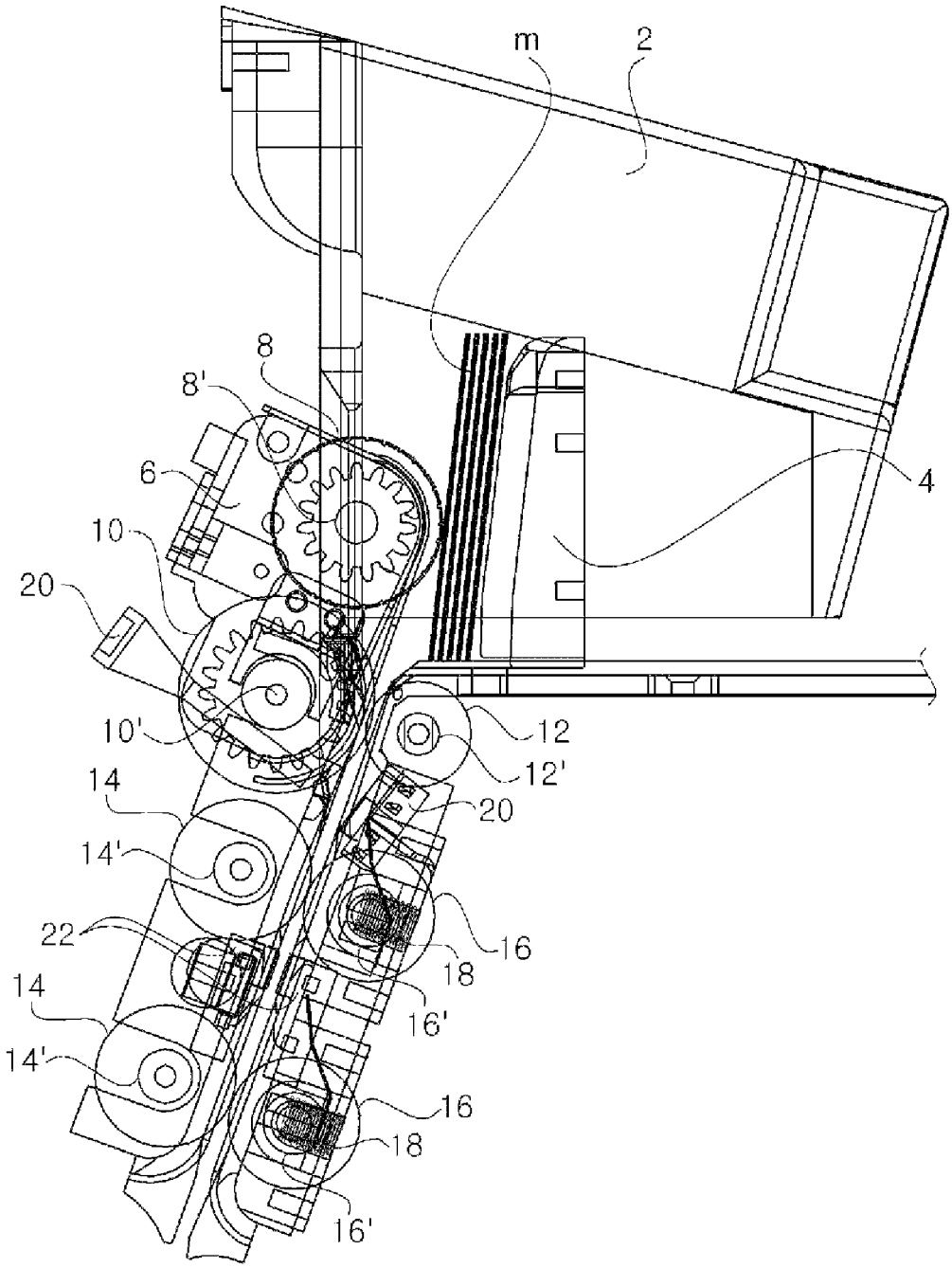

【FIG.3】
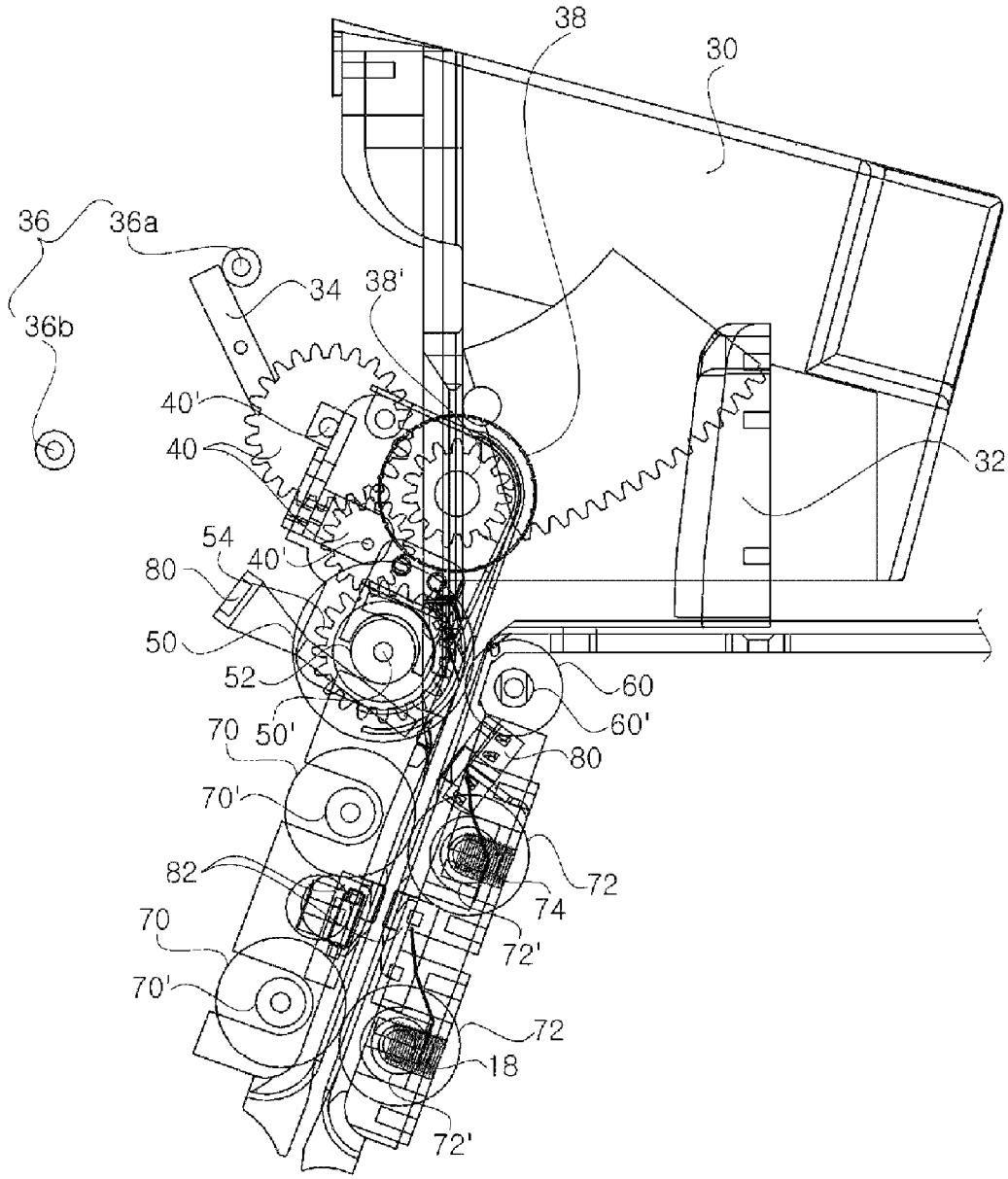

【FIG.4a】
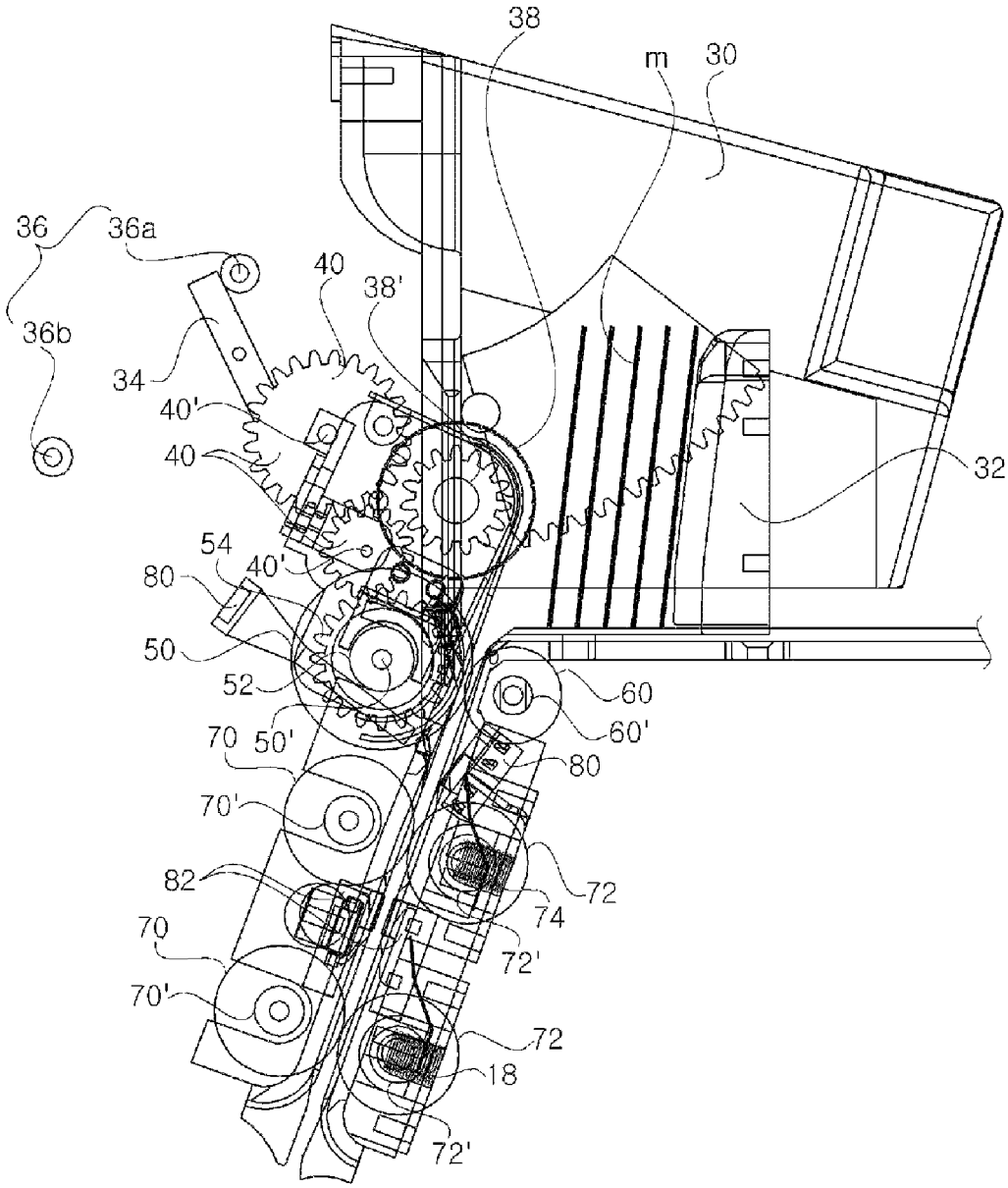

【FIG.4b】
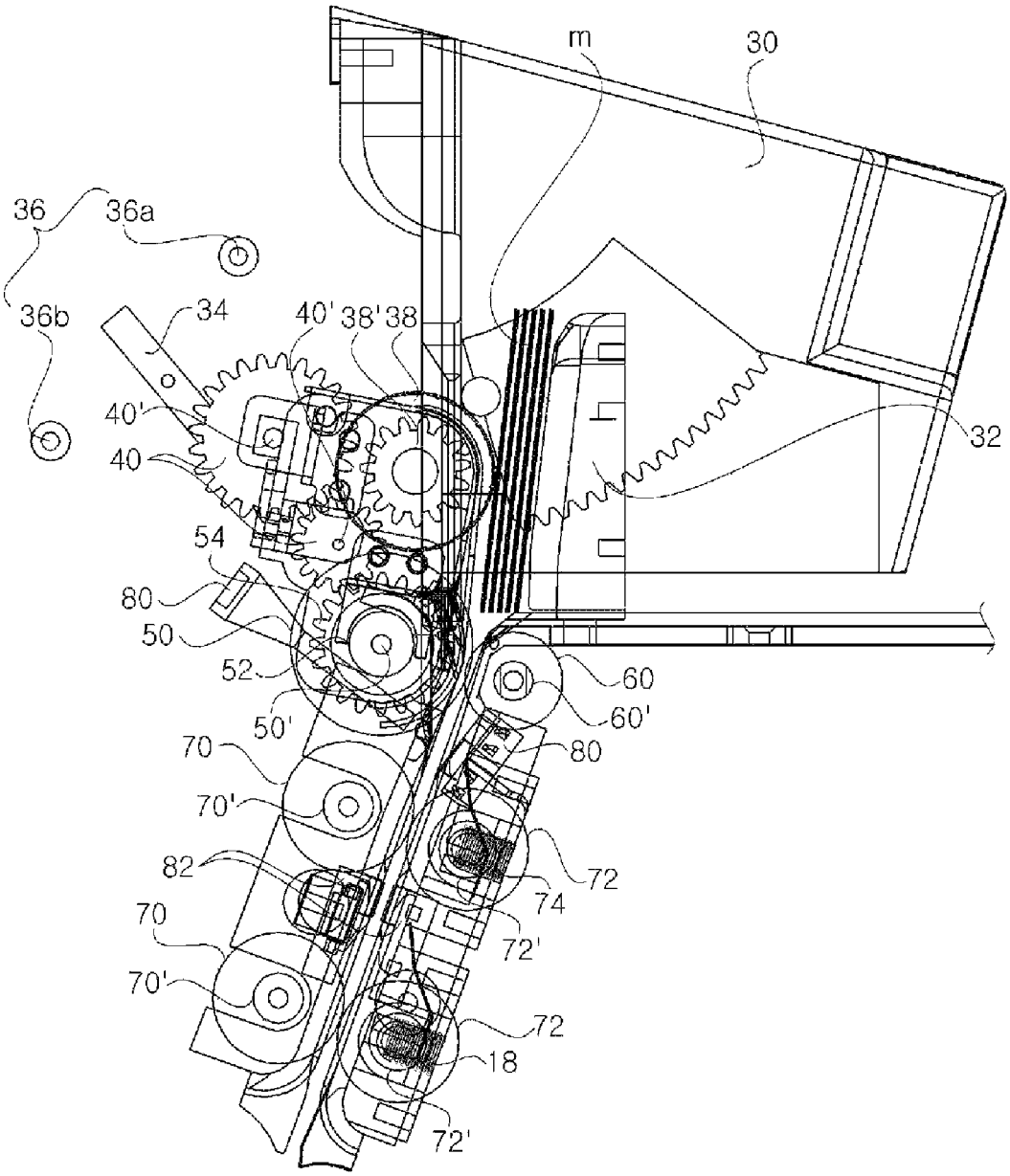

【FIG.4c】
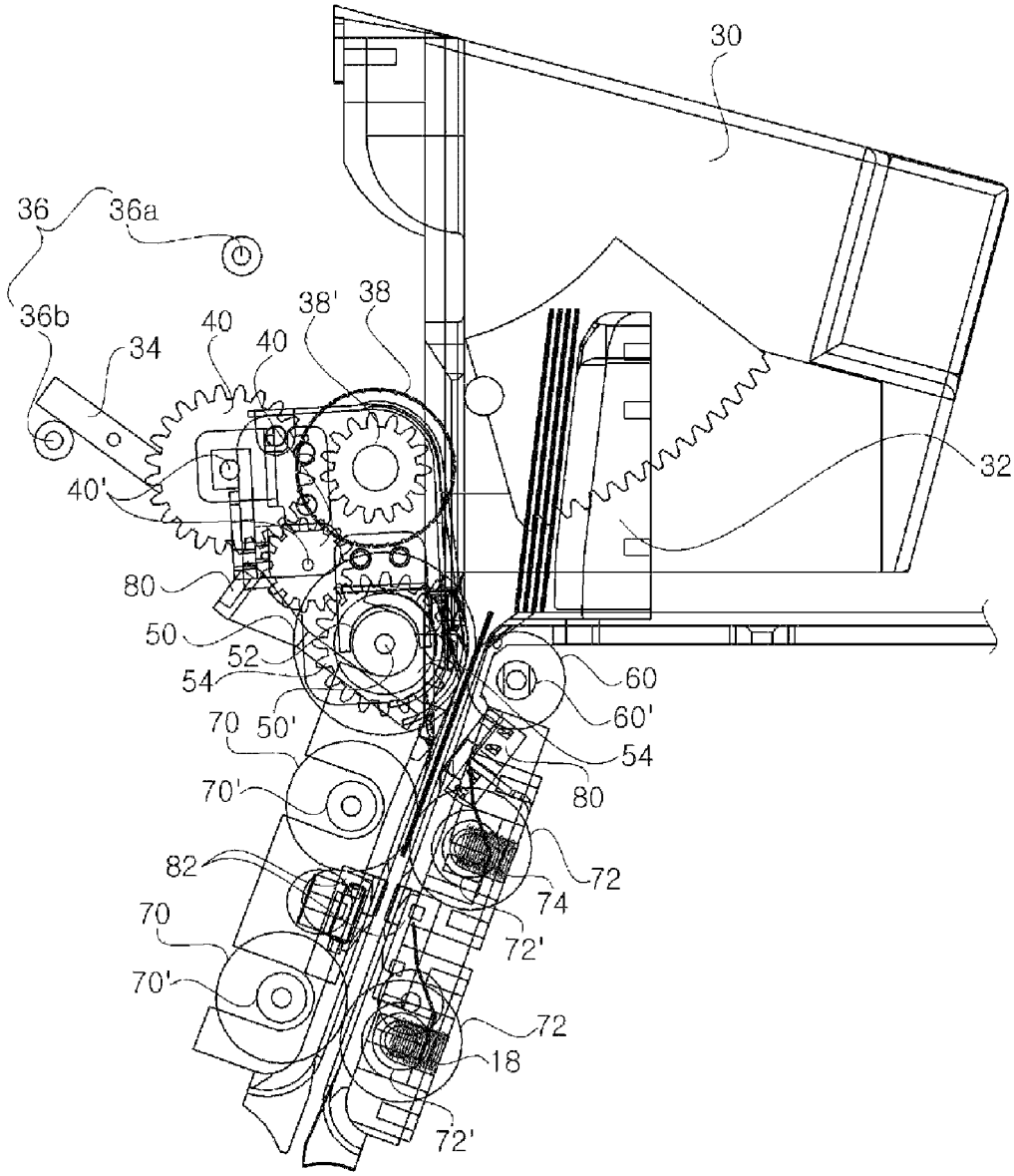

MEDIA SEPARATING APPARATUS OF AUTOMATIC MEDIA DISPENSER

CROSS REFERENCE TO RELATED APPLICATION

This application claims the priority of Korean Patent Application No. 10-2008-0006286, filed on Jan. 21, 2008 in the KIPO (Korean Intellectual Property Office), the disclosure of which is incorporated herein in their entirety by reference. Further, this application is the National Phase application of International Application No. PCT/KR2009/000276, filed Jan. 19, 2009, which designates the United States and was published in English. Each of these applications is hereby incorporated by reference in their entirety into the present application.

TECHNICAL FIELD

The present invention relates to an automatic media dispenser, and more particularly, to a media separating device of an automatic media dispenser, which separates media one by one from a media box in which the media are stored.

BACKGROUND ART

An automatic media dispenser is a device for dealing in media such as bills and the like having a commercial value. Such an automatic media dispenser is installed in a bank, a government office, a school and the like to deal in various media. The term "media" used herein refers to various sheets, for example, bills, checks, tickets, certificates and the like which have a thickness remarkably smaller than a width or length.

FIG. 1 is a view illustrating the configuration of a media separating device of an automatic media dispenser according to a prior art, and FIG. 2 is a view illustrating a state where a medium is in close contact with a pick-up roller in the media separating device of the automatic media dispenser according to the prior art.

As shown in the figures, media m are received and arranged in a media box 2. In the media box 2, the media m are pushed by a push plate 4 in one direction and are brought into close contact with each other. To this end, the push plate 4 is supported by a spring (not shown).

A pick-up bracket 6 is rotatably installed at a portion of the media box 2 through which the medium m is discharged. Substantially, the pick-up bracket 6 is rotatably provided on a feed roller shaft 10', which will be described below. The pick-up bracket 6 is installed such that elastic force is applied to the pick-up bracket 6 toward the push plate 4 by an elastic member such as a spring (not shown).

In the meantime, a pick-up roller 8 is rotatably installed to on the pick-up bracket 6. The pick-up roller 8 is rotatably provided on a pick-up roller shaft 8' installed to the pick-up bracket 6. The pick-up roller 8 is in close contact with the medium m in the media box 2 and serves to convey the medium m out of the media box 2. The pick-up roller 8 is rotated by a driving source (not shown) provided in the pick-up bracket 6.

Meanwhile, the medium m picked up by the pick-up roller 8 is conveyed by a feed roller 10. The feed roller 10 is rotatably provided on a feed roller shaft 10'. The feed roller 10 is in close contact with one surface of the medium m so that the medium m is conveyed by the friction force between the feed roller and the medium.

In addition, a contra-roller 12 is rotatably provided on a contra-roller shaft 12' and cooperates with the feed roller 10 to separate the media m one by one. When the medium m is conveyed, the contra-roller 12 is in a halt state for separating the media m one by one. It will be apparent that the contra-roller 12 can be provided such that the contra-roller is rotated in a direction reverse to a direction in which the medium m is conveyed.

The medium m that has passed through between the feed roller 10 and the contra-roller 12 is conveyed by a conveying roller 14. The conveying roller 14 is rotatably provided on a conveying roller shaft 14'. A plurality of conveying rollers 14 may be provided on a conveyance path on the medium m.

In addition, there is provided a conveying bearing 16 corresponding to the conveying roller 14. The conveying bearing 16 cooperates with the conveying roller 14 to convey the medium m. The conveying bearing 16 is rotatably provided on a bearing shaft 16'. The conveying bearing 16 is elastically supported by a spring 18. The spring 18 provides the elastic force in a direction in which the conveying bearing 16 is brought into close contact with the medium m, thereby enabling the medium m to be smoothly conveyed.

In the meantime, a skew detecting sensor 20 is provided on a conveying path of the medium m that has passed through the feed roller 10. The skew detecting sensor 20 serves to detect a skew of the medium m. The term "skew" refers to a state in which the medium m is excessively slanted from side to side. After detecting a skew of the medium m, the skew detecting sensor 20 sends a signal to the feed roller 10 and the conveying roller 14 to control a rotation direction thereof. That is, if the skew detecting sensor 20 detects a skew of the medium m, it sends a signal to the feed roller 10 and the conveying roller 14 to rotate the rollers 10 and 14 in a direction reverse to the direction in which the medium m is conveyed.

A process of conveying the medium according to the configuration of the prior art described above will be briefly illustrated. As shown in FIG. 1, the media m received in the media box 2 are pushed by the push plate 4 such that they are brought into close contact with the pick-up roller 8. At this time, the pick-up bracket 6 is rotated about the feed roller shaft 10' in a direction away from the push plate 4 by the pushing force of the push plate 4. Such a state is shown in FIG. 2.

The media m picked up by the pick-up roller 8 are separated one by one by the feed roller 10 and the contra-roller 12. Then, the medium m that has passed through the feed roller 10 passes by the skew detecting sensor 20. At this time, if a skew of the medium m is detected by the skew detecting sensor 20, the skew detecting sensor 20 sends the signal to the feed roller 10, the conveying roller 14 and the conveying bearing 16 to rotate them in a direction reverse to the direction in which the medium m is conveyed.

Then, the medium m is conveyed in the reverse direction and received again in the media box 2. The medium m which is received in the media box 2 and re-arranged to correct a skew thereof is picked up by the pick-up roller 8 and then conveyed through the aforementioned processes.

However, the above related art has the following problems.

If no skew occurs on the medium m in a process of conveying it, the medium m can be conveyed smoothly by the feed roller 10, the contra-roller 12 and the like, so that any trouble is not caused.

However, if a skew of the medium m occurs and the medium m is then conveyed in a reverse direction, there is a problem in that the medium m interferes with the pick-up roller 8 when the medium m is received again in the media box 2. That is, when the medium m received in the media box 2 is picked up by the pick-up roller 8, the foregoing problem is caused since the push plate 2 pushes the media m to make them be in close contact with the pick-up roller 8.

Accordingly, in a process where the medium m is conveyed in the reverse direction and introduced between the pick-up roller 8 and another medium for correcting a skew, a problem that a leading end of the medium m is folded or crumpled may occur. If the medium m is accumulated while the leading end of the medium m is folded or crumpled as described above, the media may be jammed.

DISCLOSURE

Technical Problem

Accordingly, the present invention is conceived to solve the aforementioned problems in the prior art. An object of the present invention is to provide a media separating device of an automatic media dispenser which can prevent a medium from interfering with a pick-up roller when a skew of the medium is detected and the medium is conveyed in a reverse direction to correct of the skew.

Technical Solution

According to an aspect of the present invention for achieving the objects, there is provided a media separating device of an automatic media dispenser, which comprises a pick-up bracket having a pick-up roller rotatably installed thereto, the pick-up roller picking up and conveying a medium received in a media box; a skew detecting sensor for detecting a skew of the medium picked up by the pick-up roller; a feed roller being in close contact with one surface of the medium to convey the medium by frictional force, the feed roller being rotated in a direction reverse to a direction in which the medium is conveyed when a skew of the medium is detected by the skew detecting sensor; a contra-roller cooperating with the feed roller to separate the medium one by one; and an interlocking means for rotating the pick-up bracket in a direction away from the push plate in response to rotation of a feed roller shaft provided with the feed roller when a skew of the medium is detected and the feed roller is rotated in the reverse direction.

The media separating device may further comprise a conveying roller conveying the medium through friction force while being in close contact with one surface of the medium, the conveying roller being rotated in the direction reverse to the direction in which the medium is conveyed when a skew of the medium is detected by the skew detecting sensor; and a conveying bearing conveying the medium in cooperation with the conveying roller.

The conveying bearing may be supported by an elastic member for providing elastic force in a direction in which the conveying bearing is brought into close contact with the medium.

One end of the pick-up bracket may be caught to a stopper to restrict a rotation range of the pick-up bracket.

The stopper may comprise a first stopping portion to which one end of the pick-up bracket is caught before the medium is brought into close contact with the pick-up roller; and a second stopping portion to which one end of the pick-up bracket is caught when the medium is conveyed in the reverse direction and introduced into the media box.

The interlocking means may comprises a one-way bearing provided on the feed roller shaft and rotated together with the feed roller shaft only when the feed roller shaft is rotated in the reverse direction of the medium; a reverse conveying gear rotated together with the one-way bearing; and an interlocking gear rotatably provided at one side of the pick-up bracket, the interlocking gear being engaged with the reverse conveying gear to rotate the pick-up bracket in a direction away from the push plate when the medium is conveyed in the reverse direction.

The media separating device may further comprise a location detecting sensor for detecting a leading end of the medium on which a skew is detected by the skew detecting sensor and sending a signal to the feed roller, the conveying roller and the conveying bearing to allow them to rotate in a reverse direction.

According to another aspect of the present invention, there is provided a media separating device of an automatic media dispenser, which comprises a pick-up bracket rotatably provided at a portion of a media box allowing a medium to be discharged therethrough; a pick-up roller rotatably installed to the pick-up bracket to pick up and convey the medium; a skew detecting sensor for detecting a skew of the medium picked up by the pick-up roller; a feed roller being in close contact with one surface of the medium to convey the medium by frictional force, the feed roller being rotated in a direction reverse to a direction in which the medium is conveyed when a skew of the medium is detected by the skew detecting sensor; a contra-roller cooperating with the feed roller to separate the medium one by one; and a stopper provided such that one end of the pick-up bracket is caught to the stopper to restrict a rotation range of the pick-up bracket.

The stopper may comprise a first stopping portion to which one end of the pick-up bracket is caught before the medium is brought into close contact with the pick-up roller; and a second stopping portion to which one end of the pick-up bracket is caught when the medium is conveyed in the reverse direction and introduced into the media box.

The media separating device may further comprise an interlocking means for rotating the pick-up bracket in a direction away from the push plate in response to rotation of a feed roller shaft provided with the feed roller when a skew of the medium is detected and the feed roller is rotated in the reverse direction.

The interlocking means may comprise a one-way bearing provided on the feed roller shaft and rotated together with the feed roller shaft only when the feed roller shaft is rotated in the reverse direction of the medium; a reverse conveying gear rotated together with the one-way bearing; and an interlocking gear rotatably provided at one side of the pick-up bracket, the interlocking gear being engaged with the reverse conveying gear to rotate the pick-up bracket in a direction away from the push plate when the medium is conveyed in the reverse direction.

Advantageous Effects

According to the present invention, when a skew of a medium is detected when the medium is separated and conveyed, a pick-up bracket mounted with a pick-up roller is rotated in a direction away from the push plate, so that the pick-up bracket is separated from the medium which is ready to be received in the media box. According to the present invention, there is an advantage in that when a skew of the medium is detected and the medium on which a skew occurs is conveyed in a reverse direction and then introduced into the media box, a folding or crumpling of an end of the medium caused by interference with the pick-up roller can be prevented, whereby making it possible to prevent the media from being jammed.

DESCRIPTION OF DRAWINGS

FIG. 1 is a view illustrating the configuration of a media separating device of an automatic media dispenser according to a prior art;

FIG. 2 is a view illustrating a state where a medium is in close contact with a pick-up roller in the media separating device of the automatic media dispenser according to the prior art FIG. 3 is a view illustrating the configuration of a preferred embodiment of a media separating device of an automatic media dispenser according to the present invention; and FIGS. 4*a* to 4*c* are views showing that a skew of the medium is detected in a process of conveying the medium by the preferred embodiment of the present invention.

BEST MODE

Hereinafter, a preferred embodiment of a dust collecting unit for a vacuum cleaner according to the present invention will be described in detail with reference to the accompanying drawings. Throughout the drawings, like reference numerals are used to designate like elements.

Hereinafter, a preferred embodiment of a media separating device of an automatic media dispenser according to the present invention will be described in detail with reference to the accompanying drawings.

FIG. 3 is a view illustrating the configuration of a preferred embodiment of a media separating device of an automatic media dispenser according to the present invention.

As shown in the figure, a media box 30 in which a great number of media m are received is mounted to an automatic media dispenser and serves to dispense the media m. A push plate 32 for pushing the media m in one direction is provided in the media box 30. The push plate 32 is provided with an elastic member such as a spring (not shown) for supporting the push plate 32 and pushing the media m in one direction. It will be apparent that the push plate 32 can be installed so as to be moved by receiving driving force from a driving source such as a motor through a driving belt.

A pick-up bracket 34 is rotatably installed at a portion of the media box 30 through which the media m are discharged. Substantially, the pick-up bracket 34 is rotatably provided on a feed roller shaft 50', which will be described below. The pick-up bracket 34 is installed such that elastic force is applied to the pick-up bracket 34 toward the push plate 32 by an elastic member such as a spring (not shown).

In addition, a rotation range of the pick-up bracket 34 is restricted by a stopper 36. The stopper 36 is provided in the automatic media dispenser, and one end of the pick-up bracket 34, which is opposite to a rotation center thereof, is caught to the stopper. The stopper 36 consists of a first stopping portion 36*a* and a second stopping portion 36*b*.

The first stopping portion 36*a* is a portion to which the end of the pick-up bracket 34 is caught when the pick-up bracket 34 is directed to the push plate 32 by the elastic force exerted thereto before the medium m is picked up. Also, the second stopping portion 36*b* is a portion to which the end of the pick-up bracket 34 is caught when the pick-up bracket 34 is rotated in a direction away from the push plate 32 in a case where the medium m is picked up and a skew occurs on the medium.

Next, a pick-up roller 38 is rotatably installed to the pick-up bracket 34. The pick-up roller 38 is rotatably provided on a pick-up roller shaft 38' installed to the pick-up bracket 34. The pick-up roller 38 serves to pick up and convey the medium m in a state where one surface of the medium m is in close contact with the pick-up roller. The pick-up roller 38 is rotated by a driving source (not shown) provided on the pick-up bracket 34. It will be apparent that, the driving force for driving the pick-up roller 38 may be provided on another component besides the pick-up bracket 34. The pick-up roller 38 feeds the media m received in the media box 30 one by one to a feed roller 50 which will be described later.

At one side of the pick-up bracket 34, an interlocking gear 40 is rotatably installed on an interlocking gear shaft 40'. The interlocking gear shaft 40' is fixedly installed to the pick-up bracket 34, and the interlocking gear 40 is engaged with a reverse conveying gear 54 which will be described later. Accordingly, if the reverse conveying gear 54 is rotated in a direction reverse to a direction in which the medium m is conveyed, the interlocking gear 40 is rotated in cooperation with the rotation of the reverse conveying gear 54 to make the pick-up bracket 34 be rotated in the direction away from the push plate 32. In this embodiment, the interlocking gear 40 consists of two gears engaged with each other. However, the present invention is not limited thereto, but the interlocking gear may consist of only one gear.

In the meantime, the medium m picked up by the pick-up roller 38 is conveyed by the feed roller 50. The feed roller 50 is rotatably installed on the feed roller shaft 50' and receives driving force from a separate driving source to rotate. The feed roller 50 is in close contact with one surface of the medium m so that the medium m is conveyed by friction force.

A one-way bearing 52 is provided on the feed roller shaft 50'. The one-way bearing 52 is rotated together with the fed roller shaft 50' only when the feed roller shaft 50' is rotated in the direction reverse to the direction in which the medium m is conveyed. The one-way bearing 52 allows the reverse conveying gear 54 and the interlocking gear 40 to be engaged with each other and rotated together when the feed roller shaft 50' is rotated in the reverse direction of the medium m. That is, the one-way bearing 52 idles when the feed roller 50 is rotated in the direction in which the medium m is conveyed, while the one-way bearing 52 is rotated along with the feed roller shaft 50' when the feed roller 50 is rotated in the direction reverse to the direction in which the medium m is conveyed.

The one-way bearing 52 is provided with the reverse conveying gear 54. The reverse conveying gear 54 is press-fitted around the one-way bearing 52 so that the reverse conveying gear and the one-way bearing 52 are rotated together. In addition, the reverse conveying gear 54 is engaged with the interlocking gear 40 to transmit the driving force to the interlocking gear 40. The reverse conveying gear 54 is provided at corresponding portions of both ends of the feed roller shaft 50' and receives no driving force from a separate driving source. That is, the reverse conveying gear 54 serves to transmit the driving force to the interlocking gear 40 only when a skew of the medium m is detected and the medium is conveyed in a reverse direction.

In the meantime, a contra-roller 60 which cooperates with the feed roller 50 and separates the media m one by one is rotatably provided on a contra-roller shaft 60'. In order to separate the media m one by one, the contra-roller 60 is in a halt state when the medium m is conveyed. It will be apparent that the contra-roller 60 may be rotated in the direction reverse to the direction in which the medium m is conveyed.

The medium m that has passed through between the feed roller 50 and the contra-roller 60 is conveyed by a conveying roller 70. The conveying roller 70 is rotatably provided on a conveying roller shaft 70'. A plurality of conveying rollers 70 may be provided on a conveying path of the medium m.

In addition, a conveying bearing 72 corresponding to the conveying roller 70 is provided. The conveying bearing 72 cooperates with the conveying roller 70 to convey the medium m. The conveying bearing 72 is rotatably provided on a bearing shaft 72'. The conveying bearing 72 is elastically supported by an elastic member 74. The elastic member 74 provides the elastic force in a direction in which the conveying bearing 72 is brought into close contact with the medium m, thereby making it possible for the medium m to be conveyed smoothly.

In the meantime, a skew detecting sensor 80 is provided on a conveying path of the medium m that has passed through the feed roller 50 and the contra-roller 60. The skew detecting sensor 80 serves to detect a skew of the medium m. The term "skew" refers to a state in which the medium m is excessively slanted from side to side. After detecting a skew of the medium m, the skew detecting sensor 80 sends a signal to the feed roller 50 and the conveying roller 70 to control a rotation direction thereof. That is, the skew detecting sensor 80 detects a skew of the medium m, the skew detecting sensor 80 sends a signal to the feed roller 50 and the conveying roller 70 to make them rotate in the direction reverse to the direction in which the medium is conveyed.

In addition, a location detecting sensor 82 is provided on a conveying path of the medium m passing through the conveying roller 70. The location detecting sensor 82 serves to detect a leading end of the moving medium m the skew of which has been detected. Specifically, if a skew of the medium m is not detected by the skew detecting sensor 80, the location detecting sensor 82 allows the medium m to be conveyed continuously. However, if a skew of the medium m is detected by the skew detecting sensor 80, the location detecting sensor 82 detects the leading end of the medium m and sends a signal to the feed roller 50 and the conveying roller 70 to make them rotate in the direction reverse to the direction in which the medium is conveyed.

It has been described in the foregoing that the skew detecting sensor 80 detects only a skew of the medium and a location of the medium m is detected by the location detecting sensor 82. However, the present invention is not limited thereto. The present invention can be configured such that the skew detecting sensor 80 may also detect a location of the medium m to determine a conveying direction of the medium m.

Hereinafter, the operation of the media separating device of the automatic media dispenser according to the present invention so configured will be described in detail with reference to FIGS. 4*a* to 4*c*.

The media m received in the media box 30 are pushed toward the pick-up roller 38 by the push plate 32. At this time, the push plate 32 is moved by elastic force of the spring (not shown) installed to the push plate 32. Accordingly, although the media m are brought into contact with the pick-up roller 38, the push plate 32 pushes continuously the pick-up roller 38 by the spring. In addition, one end of the pick-up bracket 34 mounted with the pick-up roller 38 is already caught to the first stopping portion 36*a* of the stopper 36.

If the push plate 32 pushes the pick-up roller 38 as described above, the pick-up bracket 34 is pushed as shown in FIG. 4*b*. Since elastic force of the spring is exerted to the pick-up bracket 34 on the feed roller shaft 50' toward the push plate 32, the push plate 32 is supported by the push force.

In addition, the medium m is picked up one by one by the pick-up roller 38. The medium m picked up by the pick-up roller 38 is introduced between the feed roller 50 and the contra-roller 60. The feed roller 50 is rotated in the direction in which the medium m is conveyed, and the contra-roller 60 is in a halt state and conveys the medium m one by one.

At this time, the one-way bearing 52 is not rotated together with the feed roller shaft 50', but is in a halt state. Accordingly, the reverse conveying gear 54 transmits no driving force to the interlocking gear 40 and a state where the pick-up bracket 34 is pushed by the push plate 32 is maintained.

Subsequent, the skew detecting sensor 80 detects a skew of the medium m that has passed through between the feed roller 50 and the contra-roller 60. Then, the medium m is conveyed by the conveying roller 70 and the conveying bearing 72. If the skew detecting sensor 80 does not detect a skew of the medium m, the medium m is continuously conveyed by the conveying roller 70 and the conveying bearing 72.

On the contrary, if the skew detecting sensor 80 detects a skew of the medium m, the location detecting sensor 82 detects the leading end of the medium m. Once the leading end of the medium m is detected by the location detecting sensor 82, a signal is transmitted to the driving source to rotate the feed roller 50, the conveying roller 40 and the conveying roller 72 in the direction reverse to the direction in which the medium m is conveyed. Accordingly, the medium m is conveyed in the reverse direction to correct the skew.

At this time, when the feed roller shaft 50' is rotated the reverse direction, the one-way bearing 52 and the feed roller shaft 50' are rotated together by the friction force the direction reverse to the direction in which the medium is conveyed. Accordingly, the reverse conveying gear 54 provided on the one-way bearing 52 is rotated together with the one-way bearing 52 in the reverse direction, and the interlocking gear 40 is interlocked with the reverse conveying gear 54 and rotated. Then, the pick-up bracket 34 provided with the interlocking gear 40 is rotated about the feed roller shaft 50' as shown in FIG. 4*c*. That is, the pick-up bracket 34 is rotated in the direction away from the push plate 32.

During the rotation of the pick-up bracket 34, one end thereof is caught to the second stopping portion 36*b*, so that the pick-up frame bracket 34 is prevented from further rotating. Accordingly, when the medium m which is reversely conveyed is introduced into the media box 30, the medium m can be prevented from interfering with the pick-up roller 38. After the skew of the medium m introduced into the media box 30 is adjusted, the medium m is picked up by the pick-up roller 38, and the aforementioned processes are repeated to convey the medium.

The scope of the present invention is not limited to the embodiment described and illustrated above but is defined by the appended claims. It will be apparent that those skilled in the art can make various modifications and changes thereto within the scope of the invention defined by the claims.

The invention claimed is:

1. A media separating device of an automatic media dispenser, comprising:

a pick-up bracket having a pick-up roller rotatably installed thereto, the pick-up roller picking up and conveying a medium received in a media box;

a skew detecting sensor for detecting a skew of the medium picked up by the pick-up roller;

a feed roller being in close contact with one surface of the medium to convey the medium by frictional force, the feed roller being rotated in a direction reverse to a direction in which the medium is conveyed when a skew of the medium is detected by the skew detecting sensor;

a contra-roller cooperating with the feed roller to separate the medium one by one; and an interlocking means for rotating the pick-up bracket in a direction away from the push plate in response to rotation of a feed roller shaft provided with the feed roller when a skew of the medium is detected and the feed roller is rotated in the reverse direction.

2. The media separating device as claimed in claim 1, further comprising:

a conveying roller conveying the medium through friction force while being in close contact with one surface of the medium, the conveying roller being rotated in the direction reverse to the direction in which the medium is conveyed when a skew of the medium is detected by the skew detecting sensor; and a conveying bearing conveying the medium in cooperation with the conveying roller.

3. The media separating device as claimed in claim 2, wherein the conveying bearing is supported by an elastic member for providing elastic force in a direction in which the conveying bearing is brought into close contact with the medium.

4. The media separating device as claimed in claim 3, wherein one end of the pick-up bracket is caught to a stopper to restrict a rotation range of the pick-up bracket.

5. The media separating device as claimed in claim 4, wherein the stopper comprises:

a first stopping portion to which one end of the pick-up bracket is caught before the medium is brought into close contact with the pick-up roller; and a second stopping portion to which one end of the pick-up bracket is caught when the medium is conveyed in the reverse direction and introduced into the media box.

6. The media separating device as claimed in claim 5, wherein the interlocking means comprises:

a one-way bearing provided on the feed roller shaft and rotated together with the feed roller shaft only when the feed roller shaft is rotated in the reverse direction of the medium;

a reverse conveying gear rotated together with the one-way bearing; and an interlocking gear rotatably provided at one side of the pick-up bracket, the interlocking gear being engaged with the reverse conveying gear to rotate the pick-up bracket in a direction away from the push plate when the medium is conveyed in the reverse direction.

7. The media separating device as claimed in claim 2, wherein the interlocking means comprises:

a one-way bearing provided on the feed roller shaft and rotated together with the feed roller shaft only when the feed roller shaft is rotated in the reverse direction of the medium;

a reverse conveying gear rotated together with the one-way bearing; and an interlocking gear rotatably provided at one side of the pick-up bracket, the interlocking gear being engaged with the reverse conveying gear to rotate the pick-up bracket in a direction away from the push plate when the medium is conveyed in the reverse direction.

8. The media separating device as claimed in claim 3, wherein the interlocking means comprises:

a one-way bearing provided on the feed roller shaft and rotated together with the feed roller shaft only when the feed roller shaft is rotated in the reverse direction of the medium;

a reverse conveying gear rotated together with the one-way bearing; and an interlocking gear rotatably provided at one side of the pick-up bracket, the interlocking gear being engaged with the reverse conveying gear to rotate the pick-up bracket in a direction away from the push plate when the medium is conveyed in the reverse direction.

9. The media separating device as claimed in claim 4, wherein the interlocking means comprises:

a one-way bearing provided on the feed roller shaft and rotated together with the feed roller shaft only when the feed roller shaft is rotated in the reverse direction of the medium;

a reverse conveying gear rotated together with the one-way bearing; and an interlocking gear rotatably provided at one side of the pick-up bracket, the interlocking gear being engaged with the reverse conveying gear to rotate the pick-up bracket in a direction away from the push plate when the medium is conveyed in the reverse direction.

10. The media separating device as claimed in claim 1, wherein the interlocking means comprises:

a one-way bearing provided on the feed roller shaft and rotated together with the feed roller shaft only when the feed roller shaft is rotated in the reverse direction of the medium;

a reverse conveying gear rotated together with the one-way bearing; and an interlocking gear rotatably provided at one side of the pick-up bracket, the interlocking gear being engaged with the reverse conveying gear to rotate the pick-up bracket in a direction away from the push plate when the medium is conveyed in the reverse direction.

11. The media separating device as claimed in claim 10, further comprising a location detecting sensor for detecting a leading end of the medium on which a skew is detected by the skew detecting sensor and sending a signal to the feed roller, the conveying roller and the conveying bearing to allow them to rotate in a reverse direction.

12. A media separating device of an automatic media dispenser, comprising:

a pick-up bracket rotatably provided at a portion of a media box allowing a medium to be discharged therethrough;

a pick-up roller rotatably installed to the pick-up bracket to pick up and convey the medium;

a skew detecting sensor for detecting a skew of the medium picked up by the pick-up roller;

a feed roller being in close contact with one surface of the medium to convey the medium by frictional force, the feed roller being rotated in a direction reverse to a direction in which the medium is conveyed when a skew of the medium is detected by the skew detecting sensor;

a contra-roller cooperating with the feed roller to separate the medium one by one; and a stopper provided such that one end of the pick-up bracket is caught to the stopper to restrict a rotation range of the pick-up bracket.

13. The media separating device as claimed in claim 12, wherein the stopper comprises:

a first stopping portion to which one end of the pick-up bracket is caught before the medium is brought into close contact with the pick-up roller; and a second stopping portion to which one end of the pick-up bracket is caught when the medium is conveyed in the reverse direction and introduced into the media box.

14. The media separating device as claimed in claim 13, further comprising an interlocking means for rotating the pick-up bracket in a direction away from the push plate in response to rotation of a feed roller shaft provided with the feed roller when a skew of the medium is detected and the feed roller is rotated in the reverse direction.

15. The media separating device as claimed in claim 12, further comprising an interlocking means for rotating the pick-up bracket in a direction away from the push plate in response to rotation of a feed roller shaft provided with the feed roller when a skew of the medium is detected and the feed roller is rotated in the reverse direction.

16. The media separating device as claimed in claim 15, wherein the interlocking means comprises:

a one-way bearing provided on the feed roller shaft and rotated together with the feed roller shaft only when the feed roller shaft is rotated in the reverse direction of the medium;

a reverse conveying gear rotated together with the one-way bearing; and an interlocking gear rotatably provided at one side of the pick-up bracket, the interlocking gear being engaged with the reverse conveying gear to rotate the pick-up bracket in a direction away from the push plate when the medium is conveyed in the reverse direction.

* * * * *